United States Patent [19]

Carpenter

[11] 4,048,734

[45] Sept. 20, 1977

[54] DITCH DIGGING APPARATUS

[76] Inventor: Erwin D. Carpenter, Rte. 1, Box 423, Alvin, Tex. 77511

[21] Appl. No.: 681,053

[22] Filed: Apr. 28, 1976

[51] Int. Cl.[2] ..... E02F 5/02

[52] U.S. Cl. ..... 37/98

[58] Field of Search ..... 37/98, 99; 193/23

[56] References Cited

U.S. PATENT DOCUMENTS

| | | | |
|---|---|---|---|
| 68,697 | 9/1867 | Clark | 37/98 |
| 156,139 | 10/1874 | Davies et al. | 37/98 |
| 311,668 | 2/1885 | Murray et al. | 37/98 |
| 353,668 | 12/1886 | Devel | 37/98 |
| 721,230 | 2/1903 | Pinion | 37/98 |
| 811,424 | 1/1906 | Mikolasek | 37/98 |
| 819,313 | 5/1906 | Reed et al. | 37/98 |
| 1,296,994 | 3/1919 | Miller | 37/98 |
| 3,235,051 | 2/1966 | Cochran | 193/23 |

*Primary Examiner*—Clifford D. Crowder
*Attorney, Agent, or Firm*—Pravel, Wilson & Gambrell

[57] ABSTRACT

An excavating implement adapted to be pulled behind a vehicle to form a ditch or trench. The implement includes a cutting trough for cutting through soil and a soil removing structure mounted with and extending into the cutting trough for receiving soil from the trough. The soil removing structure forms a passageway for soil to pass laterally beyond the cutting trough so that soil may be removed from the trough while the trough is cutting. A depth control structure controls the depth at which the cutting trough cuts through the soil, thereby controlling the depth of the ditch made by the apparatus.

1 Claim, 3 Drawing Figures

DITCH DIGGING APPARATUS

BACKGROUND OF THE INVENTION

The field of this invention is excavating implements and the like.

The need for efficient, reliable ditching or trenching implements has provided the impetus for many inventions. Known digging implements include the tree digging apparatus disclosed in U.S. Pat. Nos. 275,575 and 1,840,126. These tree digging devices provided a structure by which a blade purportedly cut through the soil to loosen it for the removal of trees. However, these devices did not include structure for removing the soil through which the blades cut and, therefore, were not well suited for typical trenching operations. Other known digging apparatus include the devices described in U.S. Pat. Nos. 2,394,940; 2,651,859; 3,319,367; and 3,511,394. These latter devices did provide structure by which soil could be removed from the trench. They and other similar devices included one or more scoops which were filled with soil and then removed from the trench so that the soil in the scoops could be deposited elsewhere. The necessity of removing the scoop from the ditch each time it was filled with soil necessarily made such apparatus somewhat inefficient because there was a substantial amount of time spent emptying the scoop rather than cutting the trench. In some instances, it was even necessary to reposition or otherwise maneuver the vehicle pulling the ditching implement in order to empty the scoop. This movement of the vehicle made the apparatus even less efficient in ditching operations. Other ditching apparatus attempted to eliminate the inefficiency of having to maneuver the pulling vehicle by providing conveyors on which the soil in the scoop could be emptied without moving the vehicle. However, these latter devices still required that the scoop be removed from the ditch in order to be emptied. A few more recent devices attempted to further reduce the inefficiency of ditching implements by providing a plurality of scoops carried on an endless chain or belt with the scoops being emptied onto conveyors which carried the soil to the side of the trench. However, even these more recent devices did not eliminate the inherent inefficiency of inserting and removing individual scoops into and out of the trenches during the ditching operations. Further, the extra structure provided was relatively complex and increased the cost of the machinery as well as requiring an expenditure for skilled labor to operate them. As a result, there still exists a substantial need for an efficient, reliable ditching or trenching apparatus which is low in cost and relatively simple to use.

SUMMARY OF THE INVENTION

It is an object of this invention to provide a new and improved ditching apparatus.

The ditching apparatus of the present invention includes a cutting trough means for cutting through soil and a soil removing means mounted with and extending into the cutting trough means for receiving soil from the cutting trough means a forming a passageway for soil to pass laterally beyond the cutting trough means. A hitch is mounted with the cutting trough means for connecting the trough to a pulling vehicle, and a depth control means controls the depth at which the cutting trough is pulled through the soil so that the depth of the ditch formed by the apparatus is controlled.

With the present invention, soil cut by the cutting trough is initially received in the trough itself. As the vehicle pulls the apparatus through more soil, the previously cut soil is forced rearwardly into the trough until it comes in contact with the soil removing means. The soil removing means extends into the trough to receive the soil that is forced to the back of the cutting trough. The soil removing means is inclined upwardly and forms at least one passageway extending rearwardly of and laterally beyond the trough so that as soil is continuously forced into the trough, it is received by the soil removing means and passed upwardly and outwardly from the trough to a point adjacent the ditch and laterally beyond the cutting trough. Because the soil removing means receives and removes soil from the cutting trough, it is not necessary to remove the cutting trough from the trench during the ditching operations. Rather, the trough can remain in the trench and continue to perform the soil cutting function. This greatly increases the efficiency of the ditching apparatus of the present invention. Further, it permits the removal of the soil without requiring the costly conveyors or endless chains employed by some known ditching apparatus. The invention additionally provides an implement which is easy to operate, thereby eliminating the need for and expense of highly skilled labor required by many known ditching apparatus.

DETAILED DESCRIPTION OF THE PREFERRED EMBODIMENTS

Figure 1:
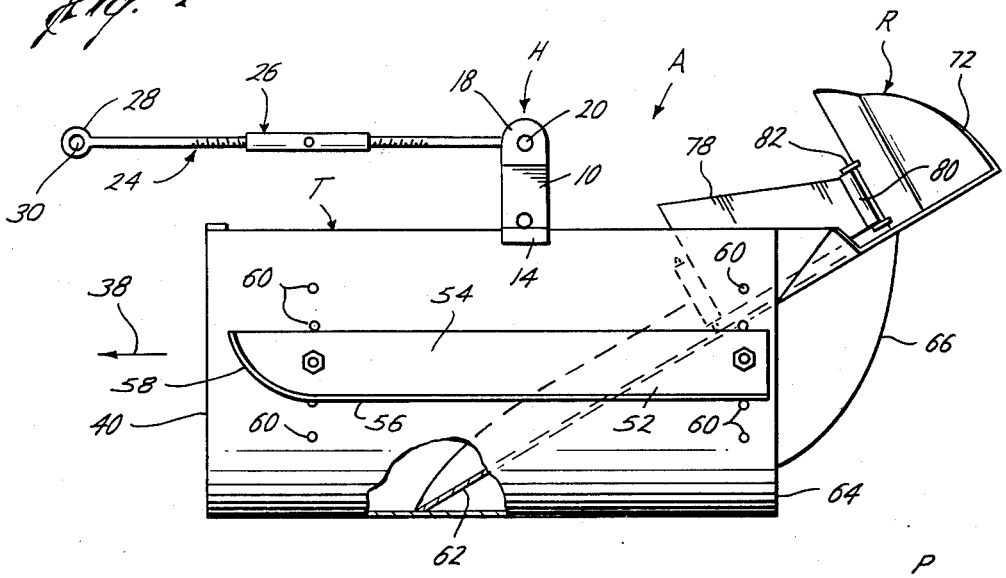
FIG. 1 is a side view of the ditching apparatus of the present invention.
Figure 2:
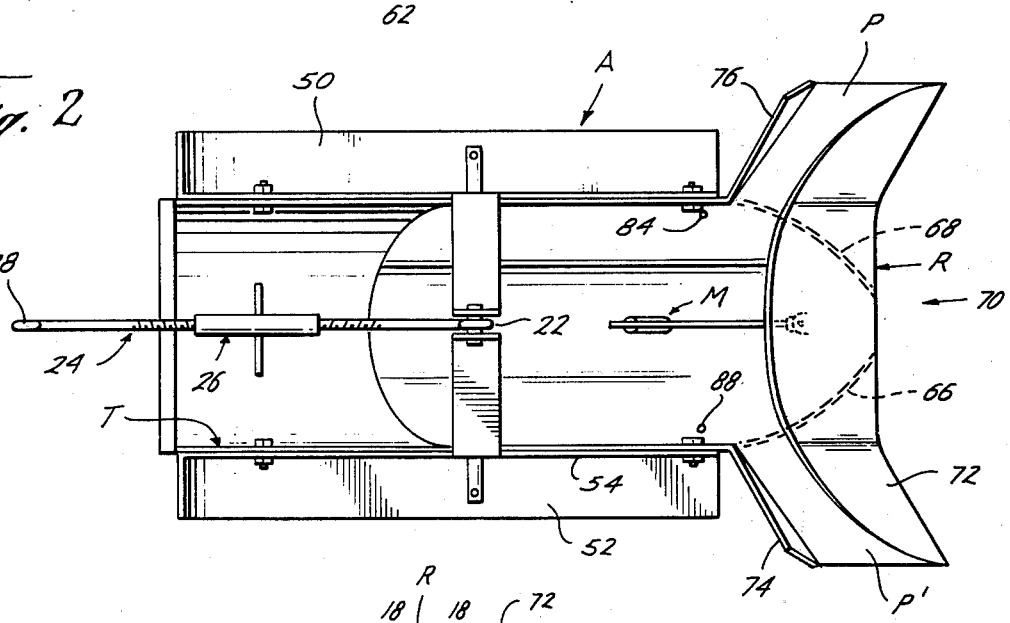
FIG. 2 is a top view of the ditching apparatus of the present invention.

In the drawings, the letter A designates generally the ditch digging apparatus of the present invention which is adapted to be pulled by a vehicle (not shown) to form a ditch or trench in the soil. The apparatus includes a cutting trough means T for cutting through the soil S, and a soil removing means R extending into the trough T for receiving soil from the trough and forming at least one passageway P through which soil from the trough T may be passed upwardly and outwardly to a position laterally beyond the trough. A hitch H is mounted with the trough T for connecting the trough to a vehicle.

The ditching apparatus A is particularly useful for forming ditches or trenches used to bury pipes, conduits, or the like around buildings. Typically, in the construction and maintenance of buildings it is necessary to bury pipes or conduits several inches beneath the ground. To accomplish this, a trench must first be dug, the pipe or conduit laid, and the ditch refilled. Accordingly, there is a significant need for an apparatus which rapidly forms the ditch or trench and leaves the excavated dirt adjacent the ditch so that the excavated dirt is readily available for filling the ditch and covering the pipe. The apparatus A provides a relatively simple implement which may be pulled by a wide variety of vehicles and used to efficiently form ditches and leave the excavated dirt adjacent the ditches for subsequent filling. It should be understood, however, that the apparatus A is in no way limited to this use, and has utility in a wide variety of ditching and trenching operations.

The ditching apparatus A is preferably formed of metal having sufficient rigidity and strength to suitably withstand the forces encountered in ditching operations. Unless otherwise indicated hereinbelow, the elements which are rigidly mounted with one another may be welded together. However, it should be understood that any materials having sufficient strength and rigidity may be used to form the apparatus of the present invention, and the structure used to join the elements of the apparatus may be adapted to the particular material used to fabricate the apparatus A.

Considering the invention in more detail, the apparatus A includes a hitch means H which provides structure by which the apparatus A may be attached to a vehicle which pulls the apparatus. While any suitable hitch structure may be employed, in the preferred embodiment of the present invention a conventional three point hitch is employed. The hitch includes a pair of braces 10 and 12, each of which extends transverse of the cutting trough T. Each of the braces 10 and 12 has a downwardly extending lip 14 extending to a side 16 of the cutting trough T and rigidly affixed to the side of the cutting trough. Upwardly extending flanges 18 of the braces 10 and 12 are positioned substantially equal distant from the edges of the cutting trough and have holes formed in them to receive a retaining rod 20 which extends through an end 22 of a pull arm 24 and thereby pivotally mounts the pull arm 24 with braces 10 and 12 and the cutting trough T. The pull arm 24 has a turnbuckle structure 26 along its length so that the effective length of the arm 24 may be adjusted in the conventional manner. An end 28 of the pull arm 24 has an eye 30 formed therein to permit attachment of the pull arm 24 to the vehicle pulling the apparatus A. The hitch means H also includes a transverse rod 32 which is secured to the hitch braces 10 and 12. Ends 34 and 36 of the rod 32 protrude beyond opposing edges of the cutting trough T to form two additional connection points of the hitch means H. Rigid arms (not shown) may be mounted with the ends 34 and 36 of rod 32 to extend to the vehicle pulling the apparatus A. It can be seen, therefore, that the apparatus A can be attached to the vehicle through the pulling arm 24 and the two ends 34 and 36 of transverse rod 32. With this connection, the ditching apparatus A may be pulled in the direction of arrow 38 to form a ditch or trench.

The cutting trough T cuts through the soil as the vehicle pulls the apparatus A in the direction of arrow 38. The trough T has a substantially U-shaped cross-sectional configuration with a central longitudinal axis substantially coincident with the central longitudinal axis of the entire apparatus A. A forward edge of the cutting trough T may be bevelled toward the outer periphery so that a sharpened edge is formed at the forward end of the trough T to aid in cutting through the soil. As the vehicle pulls the apparatus A through the soil, the cutting edge 40 cuts through the soil, and the cut soil is initially received in the mouth 42 of the cutting trough T.

Alternately, a cutting edge attachment (not shown) having the same substantially U-shaped cross-sectional configuration as the cutting trough T may be detachedly mounted to the forward edge of the cutting trough T by suitable conventional means known to those in the ditch digging or farming implement art. The forward edge of the cutting edge attachment provides a cutting edge which cuts through the soil as the vehicle pulls the apparatus A. The use of such cutting edge attachments permit the replacement of the cutting edge at regular intervals since such cutting edges commonly wear out due to the abrasive action of the soil on the cutting edge.

In addition, the use of cutting edge attachments permit the use of a variety of different cutting edges with the cutting trough T. In this manner, the most optimum cutting edge for the type of soil in which the digging is to occur may be used.

Figure 3:
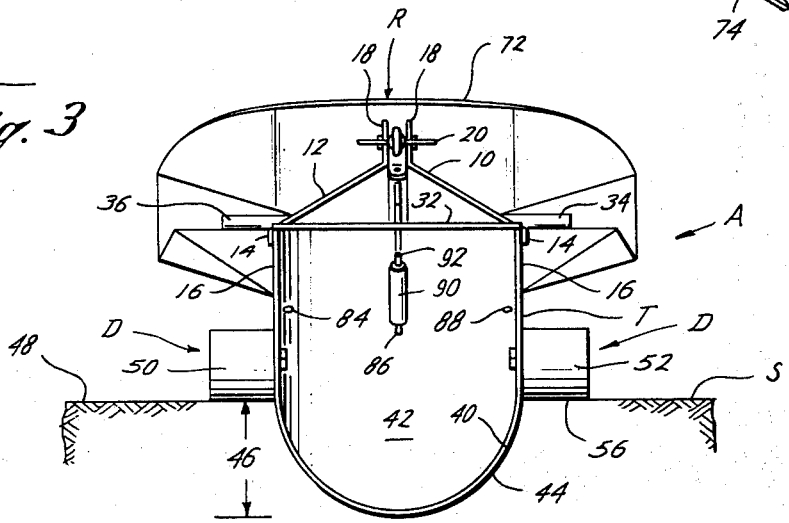
FIG. 3 is a frontal view of the ditching apparatus of the present invention.

As can be seen from FIG. 3, the lower portion 44 of the cutting trough T cuts through the soil S at a depth 46 beneath the soil surface 48. To control the depth 46 of the cut and, hence, the depth of the resulting ditch or trench, the apparatus A is provided with a depth control means D. The depth control means includes a pair of skids 50 and 52 mounted on opposing sides of the cutting trough T. Preferably, each of the skids includes a vertical, longitudinally extending flange 54 and a runner 56. The runner 56 forms a flat surface which can ride on the surface 48 of the soil S to support the trough T at the desired depth. A forward edge 58 of the runner 56 is arcuate or inclined upwardly to ensure that the runner 56 does not dig into the soil S, but rather slides along the top of the soil. Each of the vertical flanges 54 of the skids 50 and 52 has a hole formed near each of its ends. A plurality of vertically aligned holes 60 are also formed in each end of each side of the cutting trough T. The skids 50 and 52 are mounted with the sides of the cutting trough T by aligning holes in the vertical flanges 54 with horizontally aligned holes in a side of the cutting trough T and bolting the skids to the cutting trough. By selecting suitable pairs of holes for mounting the skids 50 and 52, the skids may be mounted at any of a plurality of vertical positions along the side of the cutting trough T. Since the runners 56 of each of these skids ride along the top 48 of the soil S to support the trough T, the selection of a suitable vertical mounting position for the skids controls the depth of the cut made by the cutting trough T.

As previously noted, the soil cut by the cutting trough T is initially received in the mouth 42 of the trough. As the vehicle pulls the ditching apparatus A along its path, the soil in the mouth 42 is forced rearwardly by the introduction of more cut soil into the mouth 42, and the cut soil is received by a receiving plate 62 of the soil removing means R. The receiving plate 62 is preferably slightly arcuate in the direction transverse to the cutting trough T and its outer edges are rigidly affixed to the interior surface of the cutting trough. As shown in the drawings, the receiving plate 62 extends to the bottom of the cutting trough T near a mid-point of the trough. The plate 62 extends rearwardly therefrom and at an incline beyond the back edge 64 of the trough T. A pair of support plates 66 and 68 may be rigidly mounted between the cutting trough T and the rear extension of the receiving plate 62 to provide support for the rearward extension of the receiving plate 62. The rear extension of receiving plate 62 joins a tail section 70 of the soil removing means R. Preferably, the tail section 70 is integrally formed with the receiving plate 62. The tail section 70 forms at least one passageway P which extends laterally beyond the edge of the cutting trough T. In the preferred embodiment illustrated in the drawings, the tail section 70 forms two passageways P and P' which extend laterally beyond the edge of opposing sides of the cutting trough T. The tail section is provided with a back plate 72 and two forward lips 74 and 76 which effectively form sides of the passageway so that soil will be directed through the passageway P or P'.

As the vehicle pulls the apparatus A through the soil, the soil is cut by the cutting trough T, and a continued introduction of cut soil into the mouth 42 of the trough T forces the previously cut soil rearwardly to receiving plate 62 and upwardly to the soil passageways P or P'. Soil is then forced through the passageways P and P' where it can be allowed to fall at a point adjacent the ditch being cut.

The apparatus A is provided with a diverting means M to divert soil to either or both of the passageways P and P' and thereby determine the side of the ditch upon which the excavated soil deposited. In a preferred embodiment of the present invention, the diverting means M includes a baffle plate 78 which is pivotally mounted by means of sleeve 80 and a pin 82 to a back plate 72 forming a part of the tail section 70 of the soil removing means. The receiving plate 62 has three holes 84, 86, and 88 formed through it, and each of the holes are equal distant from the pin 82 which pivotally mounts the baffle plate 78 with the back plate 72. The forward end of the baffle plate 78 has a sleeve 90 affixed to it so that a pin 92 can be inserted through the sleeve 90 and into one of the holes 84, 86, or 88 to retain the baffle plate in a desired position. When the baffle plate is mounted to extend between the pin 82 and hole 84 in the receiving plate, the baffle plate effectively blocks the soil passageway P and thereby diverts the soil to soil passageway P'. Conversely, when the baffle plate 78 extends between pin 82 and hole 88, the baffle plate effectively blocks the passage of soil through soil passageway P' and diverts soil through passageway P only. Finally, in its third position the baffle plate 78 extends from pin 82 to hole 86, and the soil from the receiving plate 62 is diverted to both the passageway P and the passageway P'. It will be appreciated, then, that by suitably positioning the baffle plate in one of its three positions, the soil cut by the ditching apparatus A can be deposited adjacent either or both sides of the ditch being dug by the apparatus.

The soil removing structure of the apparatus A provides significant advantages of the ditching apparatus known in the prior art. The receiving plate 62 of the soil removing means R extends into the cutting trough T and removes soil from the cutting trough as the apparatus A is pulled along the line of the ditch being dug. There is no need to remove the trough from the ditch to empty the trough. Further, the apparatus A can be continuously pulled along the line of the ditch being dug and is therefore efficient in ditching operations. The depth at which the apparatus A cuts the ditch may be easily selected prior to the commencement of the ditching operation, and the depth control means maintains the apparatus A at the proper cutting depth. Thus, it can be seen that the apparatus of the present invention is not only efficient but easy to operate so that the amount of skilled labor required to perform ditching or trenching operations is substantially reduced.

The foregoing disclosure and description of the invention are illustrative and explanatory thereof, and various changes in the size, shape, and materials as well as in the details of the illustrated construction may be made without departing from the spirit and scope of the invention.

I Claim:

1. An excavating implement adapted to be pulled by a vehicle, comprising:

cutting trough means for cutting through soil;

soil removing means mounted with and extending into said trough means for receiving soil from said trough means and forming a passageway for soil to pass laterally beyond said trough means;

hitch means mounted with said trough means for connecting said trough means to a vehicle;

depth control means for controlling the depth at which said cutting trough means cuts through soil comprising skid means mounted with said cutting trough means for supporting said cutting trough means at a desired depth in the soil;

mounting means for mounting said skid means with said cutting trough means in any of a plurality of selected positions to control the depth in the soil at which said skid means supports said cutting trough means;

said soil removing means forming a first passageway for soil to pass laterally beyond a first side of said cutting trough means and a second passageway for soil to pass laterally beyond a second side of said cutting trough means;

diverting means mounted with said soil removing means for alternatively diverting soil to said first passageway, to said second passageway, and to both first and second passageways;

said diverting means comprising a baffle plate pivotally mounted with said soil removing means for movement between a first position blocking said second passageway, a second position blocking said first passageway, and a third position blocking neither said first passageway nor said second passageway; and the cutting trough means comprising trough means having a substantially U-shaped cross-sectional configuration and cutting edge attachment means mounted with the forward edge of said trough means for cutting through soil.

* * * * *